US006648077B2

(12) United States Patent
Hoffman

(10) Patent No.: US 6,648,077 B2
(45) Date of Patent: Nov. 18, 2003

(54) FIRE EXTINGUISHING SYSTEM

(76) Inventor: Bryan K. Hoffman, P.O. Box 10573, Murfreesboro, TN (US) 37129

( * ) Notice: Subject to any disclaimer, the term of this patent is extended or adjusted under 35 U.S.C. 154(b) by 224 days.

(21) Appl. No.: 09/902,626

(22) Filed: Jul. 12, 2001

(65) Prior Publication Data

US 2003/0010509 A1 Jan. 16, 2003

(51) Int. Cl.[7] ..... A62C 37/00

(52) U.S. Cl. ..... 169/56; 169/37; 169/54; 169/60; 169/65

(58) Field of Search ..... 169/16, 37, 54, 169/56, 60, 65; 239/68, 70, 209

(56) References Cited

U.S. PATENT DOCUMENTS

| | | | | |
|---|---|---|---|---|
| 2,017,841 A | | 10/1935 | Coleman | |
| 4,047,570 A | | 9/1977 | Munk | |
| 4,091,876 A | | 5/1978 | Valdatta | |
| 4,366,865 A | | 1/1983 | Makibbin | |
| 4,484,634 A | | 11/1984 | Swanson et al. | |
| 4,773,485 A | * | 9/1988 | Silverman | 169/54 |
| 4,930,579 A | | 6/1990 | George | |
| 4,979,572 A | * | 12/1990 | Mikulec | 169/65 |
| 5,570,745 A | | 11/1996 | MacDonald, III | |
| 6,000,474 A | * | 12/1999 | Warnick et al. | 169/54 |
| 6,029,751 A | * | 2/2000 | Ford et al. | 169/60 |
| 6,076,608 A | | 6/2000 | MacDonald, III et al. | |

FOREIGN PATENT DOCUMENTS

| | | |
|---|---|---|
| JP | 05-293195 | 11/1993 |
| JP | 05-293196 | 11/1993 |
| JP | 08-010350 | 1/1996 |
| JP | 10-127812 | 5/1998 |

* cited by examiner

*Primary Examiner*—Steven J. Ganey
(74) *Attorney, Agent, or Firm*—Richard C. Litman

(57) ABSTRACT

A fire extinguishing system is adapted particularly for incorporation with a clothes dryer in a home laundry area, for extinguishing any fire occurring from ignition of lint or other combustible material. The system may also be installed with other large, heat producing appliances (kitchen stove, etc.) for extinguishing any fire resulting therefrom. The system includes one or more conventional, heat activated fire extinguisher spray heads connected to the main water line of the structure. Each extinguisher head is secured in a fitting including an automatically actuated water shutoff valve, which closes after the fire has been extinguished to reduce water damage to the surrounding area. The system also includes an automatic disconnect or shutoff for at least the electrical circuit associated with the appliance which causes activation of the extinguisher head, and may further include an automatically actuated local (household) and/or distant (fire department) alarm.

18 Claims, 4 Drawing Sheets

FIRE EXTINGUISHING SYSTEM

BACKGROUND OF THE INVENTION

1. Field of the Invention

The present invention relates generally to devices and systems for protecting structures and appliances from fire(s) and extinguishing any such fire(s) which may occur. More specifically, the present invention comprises a fire extinguishing system which is most particularly adaptable to household use in extinguishing any fire which may occur due to a malfunctioning appliance (clothes dryer, stove, etc.). The present system automatically extinguishes a fire when it occurs, shuts off any electrical power to the affected appliance to remove any electrical ignition source, signals appropriate authorities and/or emits an alarm, and then shuts down the water supply after the fire has been extinguished in order to minimize water damage.

2. Description of the Related Art

The ever increasing demand for labor saving appliances of various sorts in residences and other structures, has led to the increasing electrification of such structures and installation of a large number of such appliances within such structures. While the time and labor saved through use of such appliances is undeniable, they nevertheless may have certain drawbacks as well.

The almost universal use of electrical energy to power, or at least control, such appliances results in some potential for fire in the event of improper or inadequate wiring or installation of the appliance. When such appliances are powered by electrical energy, particularly where electricity is used to produce heat, may result in a fire hazard if the equipment is not used and maintained properly.

This is perhaps most evident in the laundry area of the typical residence, where lint buildup can create a potential fire hazard if not disposed of regularly. While all clothes dryers include lint traps and vents which exhaust moist air (and a certain amount of lint therewith, which has passed through the filter), lint comprising extremely fine clothing fibers, hair particles, and other potentially flammable fine particles, will still build up in and around various areas of the machine over a period of time. Other appliances may produce some fire hazard as well, such as stoves and other kitchen appliances, with the potential fire hazard of spilled food, grease, etc.

The above noted hazards are well recognized, and various safety organizations have issued warnings and reminders of these and other household fire hazards for years. In fact, it is almost universally recommended by such safety organizations and insurance companies, that hand held fire extinguishers, smoke detectors, and/or other fire safety equipment be provided or installed in every household or other area where a potential fire hazard may exist.

While smoke detectors provide warning of an overheated area or appliance, they do nothing per se to extinguish any fire which may occur. Hand held fire extinguishers are of course an excellent safety tool, but are limited to such instances where a responsible party is at the site of the fire; they do nothing when a fire occurs in an unattended area, and/or when people are away from the structure. With the automation of many appliances, the potential for fire when the structure is unoccupied increases greatly.

Accordingly, a need will be seen for an automated fire extinguishing system which is activated automatically upon receiving a sufficient heat input, and which also serves to automatically shut down the electrical supply to the affected appliance or area in order to eliminate any potential electrical ignition source. The present system may also provide notification to appropriate authorities (fire dept., etc.) and/or provide an alarm for any persons within the structure. Finally, with the elimination of electrical ignition sources and extinguishing of any fire which has occurred, the present fire extinguishing system also automatically shuts down the water flow after the fire has been put out, in order to minimize water damage to the area. The present fire extinguishing system is easily installed in a residence, apartment, small business, or other structure in which such fire protection may be required.

A discussion of the related art of which the present inventor is aware, and its differences and distinctions from the present invention, is provided below.

U.S. Pat. No. 2,017,841 issued on Oct. 22, 1935 to John B. Coleman, titled "Domestic Sprinkler System," describes an automated fire extinguishing system for household installation. The Coleman system differs considerably from the present system, in that it is intended for general area coverage rather than for application to specific areas where various appliances may be installed, for extinguishing fires which might occur due to those appliances. Moreover, the Coleman device requires that the water be shut off manually after actuation of the extinguishing sprinkler(s), while the present invention provides automated water shutoff means after the fire has been extinguished. Moreover, while Coleman provides automated electrical alarm means with his extinguishing system, such means is battery powered and does not interface with the standard household electrical system, and accordingly cannot provide any means for disconnecting such an electrical system from any appliance (s).

U.S. Pat. No. 4,047,570 issued on Sep. 13, 1977 to Michael E. Munk, titled "Sprinkler System For Existing Buildings," describes a system in which the plumbing is installed through existing heating and air conditioning ductwork. Munk provides a pneumatically actuated alarm system, with the air pressure causing electrical contacts to close when opposing water pressure drops as the system is activated. However, Munk fails to provide any means for automatically deactivating any associated electrical system (s) nor for automatically shutting off the water supply to the sprinkler head(s), as provided by the present invention.

U.S. Pat. No. 4,091,876 issued on May 30, 1978 to Robert P. P. Valdatta, titled "Fire Sprinkling System For Mobile Trailers," describes a manually activated system using carbon dioxide, water, or both agents. A tank of compressed carbon dioxide is provided externally to the trailer, with a manually controlled valve to the distribution line. A hose bib and shutoff valve are provided for attachment of a water line thereto. In the event of a fire, a person must manually open the carbon dioxide control valve to distribute the carbon dioxide, and/or connect a water hose to the hose bib and open the water shutoff valve to provide water to the extinguishing system. No automated means of extinguishing a fire is provided by Valdatta, nor is any means provided for automatically actuating an electrical alarm, automatically shutting off any electrical power source(s), or automatically shutting off the water supply after the fire has been extinguished.

U.S. Pat. No. 4,366,865 issued on Jan. 4, 1983 to James J. Makibbin, titled "Packaged Sprinkler System Using A Dead Water Tank," describes a fire extinguishing system using conventional heat actuated sprinkler heads and a conventional household water supply. A backup water supply from a dead water tank may be electrically switched to provide additional water flow and/or pressure as required. However, the Makibbin system does not include any means for automatically shutting off any household or structural electrical power nor for automatically shutting off the water flow after the fire has been extinguished, as provided by the present fire extinguishing system invention.

U.S. Pat. No. 4,484,634 issued on Nov. 27, 1984 to Kenneth R. Swanson et al., titled "Flexible Fire Protection System, " describes a water distribution system comprising a series of swivel connected rigid pipes having distal fire sprinkler heads disposed in movable cabinets or storage racks. The swivel connections and arcuate pipe support tracks permit the water distribution system to be moved as required along with the movement of the cabinets or storage racks. However, the Swanson et al. system does not include any automated electrical or water shutoff means, as provided by the present fire extinguishing system invention.

U.S. Pat. No. 4,930,579 issued on Jun. 5, 1990 to Gary George, titled "Fire Extinguishing Device For The Home Heating Plant Utilizing An Existing Spigot As The Water Source, " describes a system using an essentially conventional heat triggered sprinkler head connected to a hose. The opposite, inlet end of the hose is connected to an existing water source, such as the drain from a hot water heater or a tee fitting installed in one of the clothes washer water supply lines. The simplicity of the George system is desirable, and may be incorporated with the water supply of the present system as well. However, George simplifies his system to the point that he does not include any electrical means for automatically disconnecting any related electrical power supply or supplies, nor does he provide any means for automatically shutting off the water output after the fire is extinguished, which means are a part of the present fire extinguishing system invention.

U.S. Pat. No. 5,570,745 issued on Nov. 5, 1996 to Norman J. MacDonald III, titled "Relocatable Sprinkler Assemblage," describes an adapter for clamping attachment to a flexible hose. The adapter is internally threaded to accept a conventional heat actuated fire sprinkler head therein and includes a shoulder with a smaller diameter threaded shank, for securing through a hole in a panel by a cooperating nut. A threaded cap or cover is also provided, for protecting the sprinkler head during relocation of the device. MacDonald III does not provide any electrical alarm or notification means, means for automatically disconnecting any adjacent electrical system, or means for automatically stopping water flow after the fire has been extinguished, all of which features are a part of the present fire extinguishing system.

U.S. Pat. No. 6,076,608 issued on Jun. 20, 2000 to Norman J. MacDonald III et al., titled "Fire-Suppression Sprinkler System And Method For Installation And Retrofit," describes a manifold system using flexible lines for running through wall structures of existing housing or other building structures. MacDonald III et al. provide various ancillary devices with their system, e.g., one way valves to prevent reverse flow into the main water supply, etc., which features are conventional and may be incorporated with the present system as well. While MacDonald III et al. provide a conventional flow detector to trigger an alarm if the system is activated, they do not provide any means for automatically disconnecting any related electrical power supply nor for automatically shutting off the water after a fire is extinguished.

Japanese Patent Publication No. 5-293,195 published on Nov. 9, 1993 to Hokichi Corp. describes (according to the drawings and English abstract) a fire extinguishing system water supply interconnected with a conventional toilet flush supply tank via a four way valve. When a fire is detected, the valve is switched to provide flow directly from the conventional main water supply to the fire extinguishing system, bypassing the toilet tank. However, when the system is in its normal state, water flows from the supply to the toilet tank, and thence to the fire extinguishing system. In this manner, any backflow flows into the toilet tank, rather than back into the household water supply. While the '195 Japanese Patent Publication appears to provide means for a fire extinguishing water supply and avoidance of backflow into the household water supply, no means is apparent for automatically shutting off any associated electrical system nor for automatically shutting off the fire extinguishing water supply after the fire has been extinguished, as provided by the present system.

Japanese Patent Publication No. 5-293,196 published on Nov. 9, 1993 to Hokichi Corp. describes (according to the drawings and English abstract) a system closely related to that of the '195 Japanese Patent Publication to the same applicant, described immediately above. The '196 Publication differs in that it includes valve position and pressure detection switches to provide notification of problems in the system. However, no automated electrical system or water shutoff is provided after actuation, as provided by the present fire extinguishing system Japanese Patent Publication No. 8-010,350 published on Jan. 16, 1996 to Nohmi Bosai Ltd. describes (according to the drawings and English abstract) a manifold system receiving water from the conventional water main supply. However, the '350 Japanese Patent Publication discloses only a single control valve upstream of the fire extinguisher sprinkler head distributor manifold, rather than providing a series of mutually independent heat activated sprinkler heads, as in the present invention. Thus, when the detector of the '350 Japanese Patent Publication senses a fire, it opens a single valve which distributes water simultaneously to all of the sprinkler heads in the system. While the '350 Japanese Publication provides alarm means as well, no disclosure is apparent for shutting off any related electrical power source nor for shutting off the fire extinguishing water supply after the fire has been extinguished, as provided by the present invention.

Finally, Japanese Patent Publication No. 10-127,812 published on May 19, 1998 to Nohmi Bosai Ltd. describes (according to the drawings and English abstract) a system drawing water from the flush water supply tank of a toilet. When a water pressure drop occurs in the fire extinguisher supply line, a pressure switch closes to activate a pump to supply water at higher pressure, with the switch simultaneously triggering an alarm. However, no means is apparent for automatically shutting off any adjacent electrical systems nor for automatically shutting off the water supply when the fire has been extinguished, which means are both a part of the present fire extinguishing system invention.

None of the above inventions and patents, taken either singularly or in combination, is seen to describe the instant invention as claimed. Thus a fire extinguishing system solving the aforementioned problems is desired.

SUMMARY OF THE INVENTION

The present invention is a fire extinguishing system adaptable for retrofit installation in existing single family dwellings and/or other similar structures. The present fire extinguishing system is particularly well adapted for installation in or near a conventional electrically or gas heated clothes dryer, where the ignition of lint buildup has been known to produce fires. However, the present system may be adapted for installation adjacent (or even within) virtually any large heat producing appliance (e.g., kitchen stove, etc.), for automatically extinguishing any fire which may occur as a result of overheating of the appliance and/or ignition of combustible materials in or near the appliance.

The present fire extinguishing system connects to the conventional water supply for the structure, and includes at least one conventional, normally closed fire extinguisher spray head or nozzle directed toward the likely fire area. The spray head is preferably triggered by heat, and is thus preferably located very close to the potential fire location for prompt activation thereof and release of water. A conventional pressure or flow detector may be provided upstream of the extinguisher spray head, for triggering a local (household, etc.) or distant (fire station) alarm as desired.

The present fire extinguisher system also anticipates that the electrical energy provided to the appliance, may serve as an undesirable ignition source for any fire which may occur. Accordingly, the present system includes means for automatically disconnecting or shutting down at least the electrical circuit associated with the appliance, when any overheating or fire is detected in or from that appliance. The present system also recognizes the extreme damage which may occur due to flooding when using a water based fire extinguishing system, and correspondingly includes means for automatically terminating the water flow after a fire has been extinguished. Where more than one fire extinguishing spray nozzle is incorporated in a system, each is independent of others, with electrical system shutdown affecting only the circuit to which the associated appliance is connected and water shutoff affecting only the actuated extinguisher head. Thus, the remainder of the system remains operable even in the event of actuation of one extinguisher head in a multiple head system.

Accordingly, it is a principal object of the invention to provide a fire extinguishing system particularly adapted for extinguishing fires occurring in large, heat producing household appliances, such as clothes dryers, kitchen stoves, and/or other appliances having electrical power and gas or electric heating.

It is another object of the invention to provide such a fire extinguishing system incorporating one or more conventional heat actuated water spray heads, which release water when submitted to sufficient heat for a predetermined period of time.

It is a further object of the invention to provide such a system including means for automatically transmitting either a local alarm within the structure, or a distant alarm to a fire department or the like, or both, when one or more fire extinguisher spray heads are actuated.

Still another object of the invention is to provide such a system including means for automatically disconnecting or shutting down at least the electrical system associated with the appliance or other object which has caused actuation of the fire extinguishing spray head.

Yet another object of the invention is to provide such a system including means for automatically shutting off water flow from the previously actuated fire extinguishing spray head, after a predetermined time has been reached or another condition has been detected which indicates that the fire has been extinguished.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
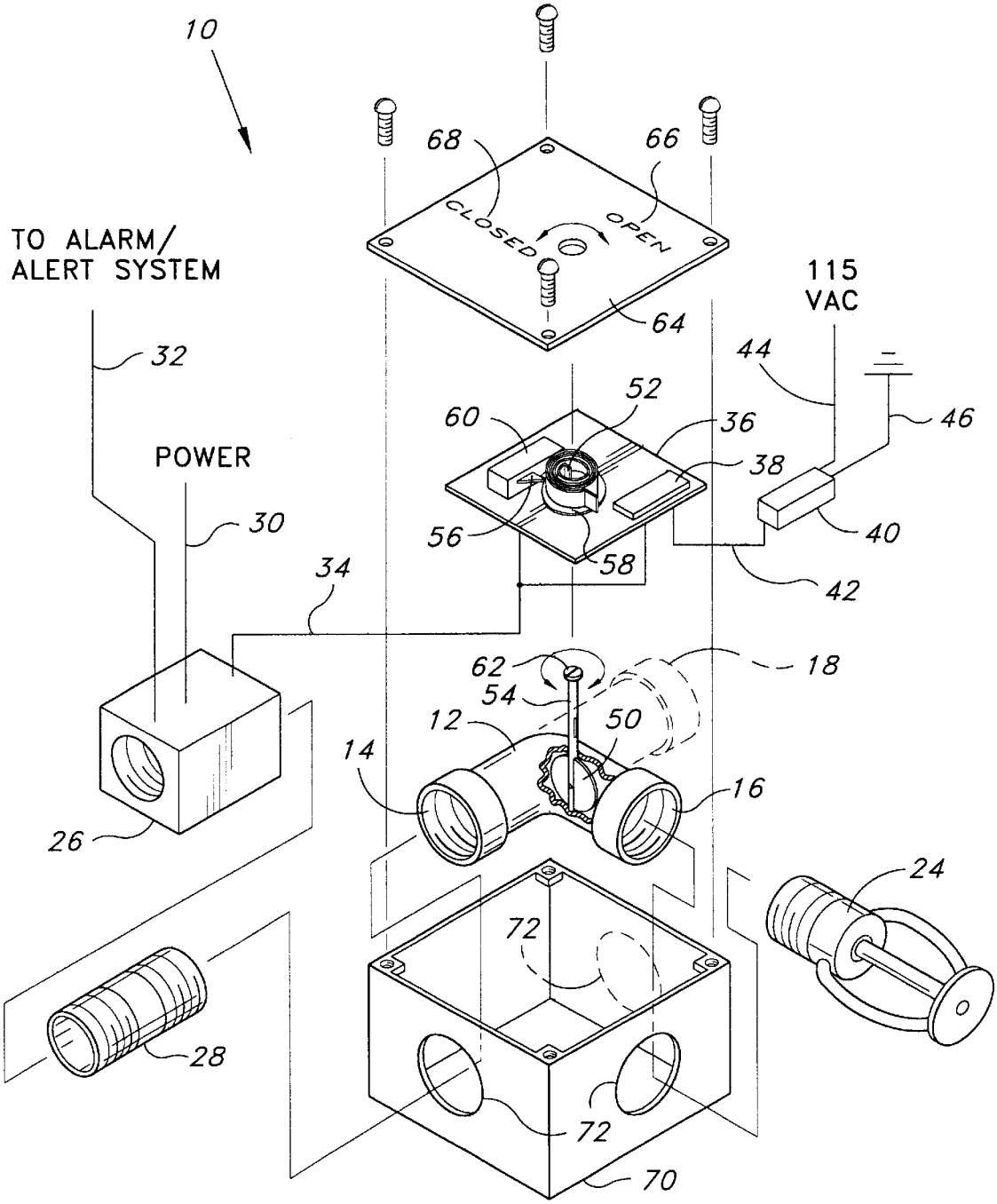
FIG. 1 is an exploded perspective view of a fire extinguishing system according to the present invention, illustrating its basic components.
Figure 2:
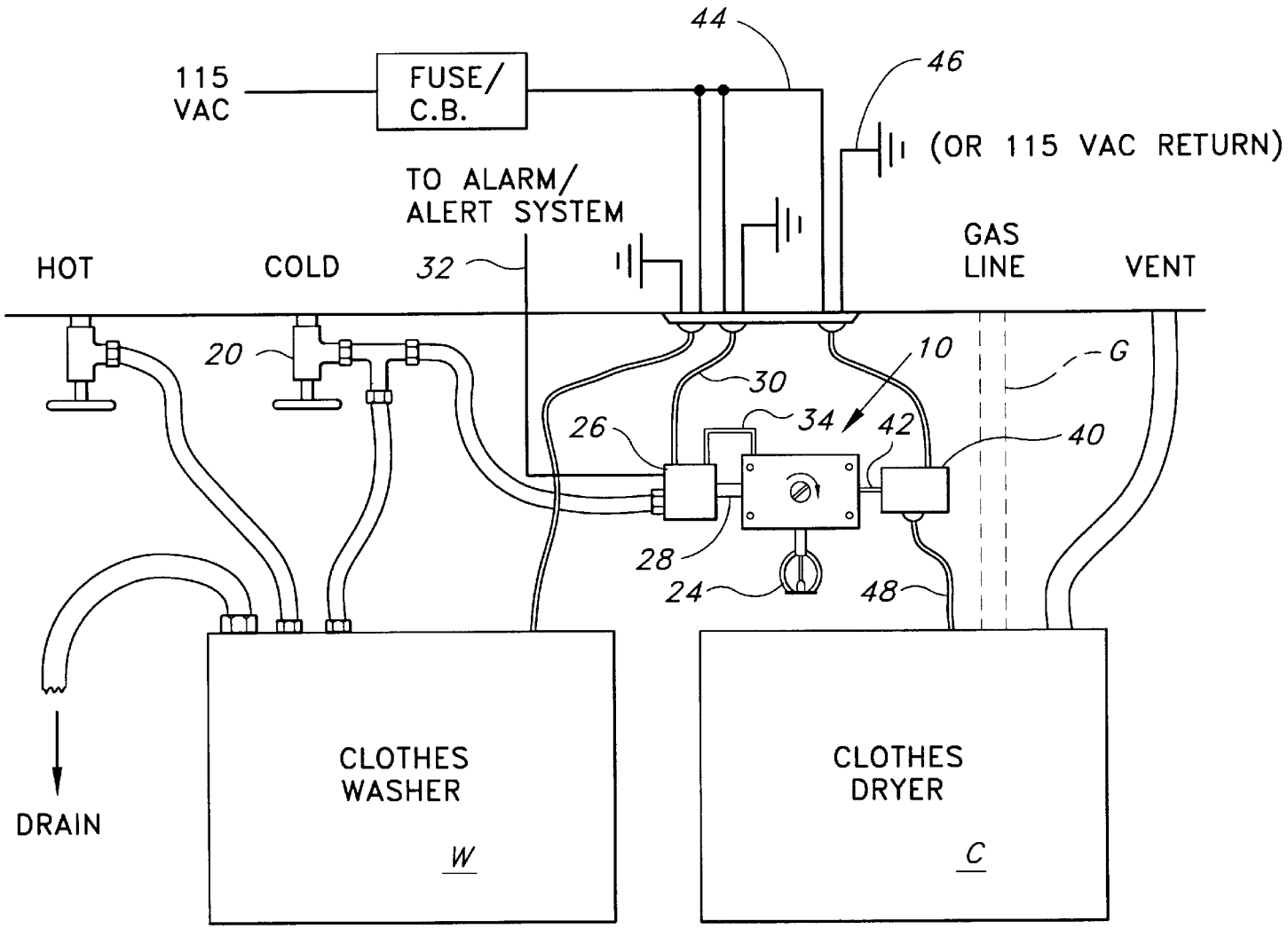
FIG. 2 is a top plan view of a single fire extinguishing system of the present invention, installed with a conventional clothes dryer in a home laundry area.
Figure 3:
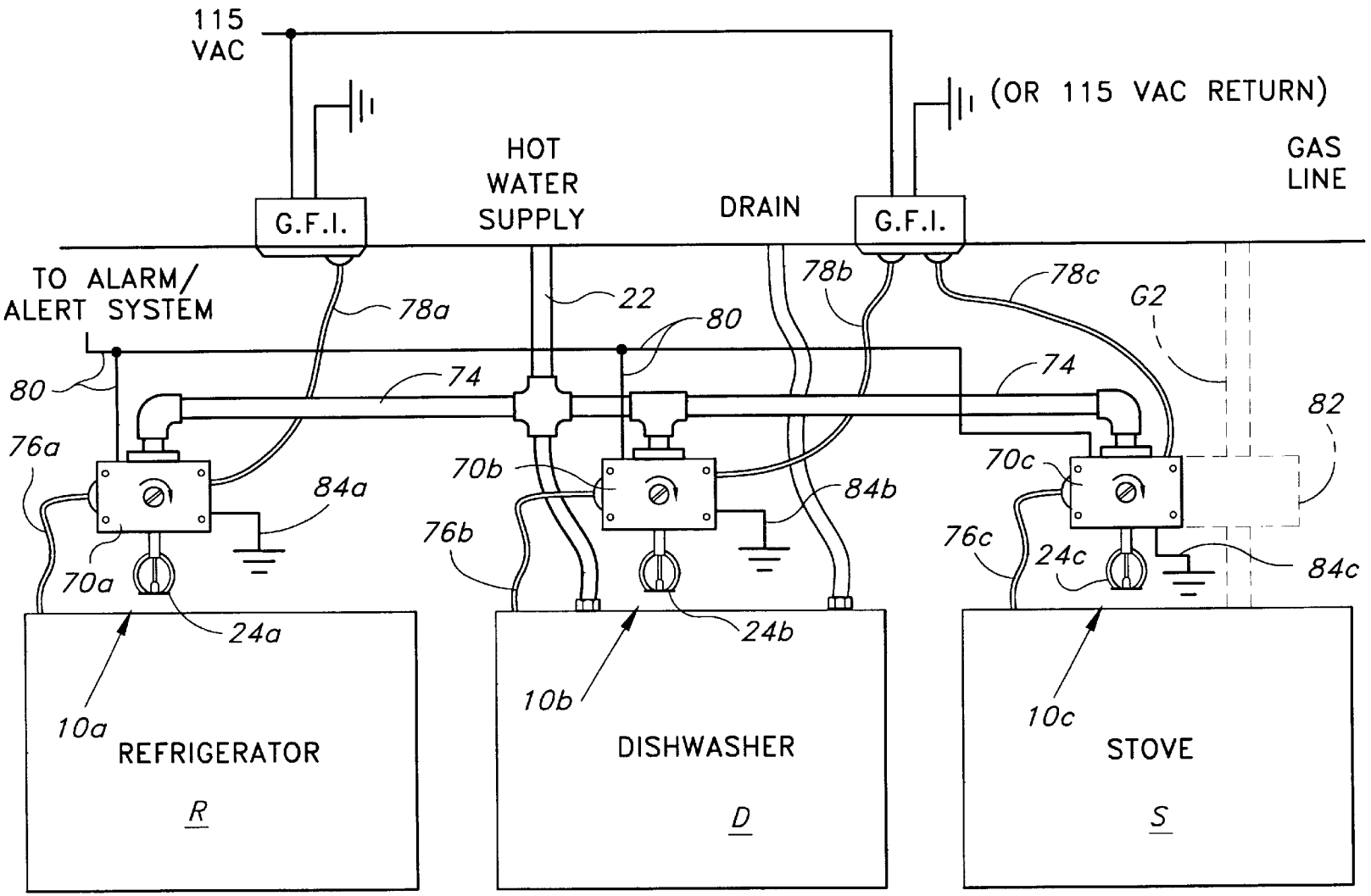
FIG. 3 is a top plan view of a series of the present fire extinguishing systems installed with a corresponding series of large appliances as in a conventional household kitchen area.

The present invention comprises a fire extinguishing system, with a first embodiment designated by the reference numeral 10 in FIGS. 1 through 3 in the drawings. The present fire extinguishing system 10 is well suited for use in extinguishing fires which may occur as a result of a malfunctioning large electrical appliance, due to electrical malfunctions and/or ignition of combustible materials (e.g., lint buildup in a clothes dryer, etc.). However, it may be readily adapted for use with other appliances as well.

FIG. 1 of the drawings provides an exploded perspective view of the componentry comprising a first embodiment 10 of the present fire extinguishing system. The system embodiment 10 includes a pipe fitting 12 having a water inflow end 14, and at least one water outflow end 16. In the case of a fitting 12 comprising an elbow, only a single inflow end 14 and outflow end 16 are provided. However, it will be seen that a series of the present fire extinguishing systems 10*a*, 10*b*, 10*c*, etc. may be assembled to provide protection for a corresponding number of appliances or for a larger area, as illustrated generally in FIG. 3 of the drawings. In such instances, the fitting 12 may comprise a tee with a second outflow end 18, as shown in broken lines in FIG. 1.

The inflow end 14 of the fitting is connected to a conventional water line which receives a water supply from the conventional water supply or main of the structure in which the present fire extinguisher system 10 is installed. The water line may comprise a cold water supply outlet 20 for a clothes washing machine W in the laundry area of a home or other structure, as shown generally in FIG. 2, or perhaps the hot water supply line 22 for a dishwasher D in the kitchen area of a home, as illustrated generally in FIG. 3 of the drawings. It will be noted that the water temperature is not critical for fire extinguishing systems, as the water will be well below the temperature of the fire in any event. However, a cold water outlet 20 is generally preferred, in order to reduce any supply restrictions and energy losses associated with passing the water through a water heater.

The first outflow end 16 of the fitting 12 has a fire extinguisher spray head 24 extending therefrom, for distributing water from the water supply line and fitting 12 in the event of a fire, overheated appliance, or other condition which triggers the release of water from the present fire extinguisher invention. The fire extinguisher spray head 24 is preferably a conventional, readily available unit incorporating an outlet plug which is held in place by a thermally activated release of conventional type (metal having a low melting point, glycerine capsule which breaks due to extreme heat, etc.). Such devices are well known and conventional, and are readily incorporated with the novel features of the present invention. Other, normally open water distribution heads may be used where a separate water control valve is provided.

A conventional water flow sensor 26 is installed with the system 10 (e.g., by means of a conventional pipe nipple 28 at the inflow end 14 of the fitting 12), for detecting any water flow from the system 10 when the spray head 24 is activated. The term "flow sensor" is intended to cover conventional pressure sensors which are triggered by a drop in water pressure when the sprinkler head 24 opens due to a fire. Such pressure sensors are commonly used in fire extinguishing systems which depend upon pressurized water as the extinguishing agent. Such pressure drop detectors are useful in determining that water flow is occurring through the system, but provide only an indirect means of determining flow. Other flow detection principles may be used equally as well with the present invention, as desired.

The flow (or pressure drop) sensor 26 includes electrical means for receiving electrical power and providing one or more electrical signals for automatically activating other electrical devices without human intervention or action. The sensor 26 of FIGS. 1 and 2 receives continuous electrical power from a suitable source (electrically separated from the electrical circuit of the associated appliance) by means of an electrical supply line 30. When the sensor 26 detects a drop in water pressure, or water flow therethrough, a set of electrical contacts are closed to send an electrical signal to an alarm system by means of an alarm line (or lines) 32. The alarm signal may be to a local alarm, i.e., an audible, visual, or other alarm within the building structure in which the present fire extinguishing system is located, or extend to a distal alarm at a fire department or the like, or both, as desired. Such automatic alarm notification systems are conventional and well known in the art, so no further description is required herein.

The activated water flow sensor 26 also sends an electrical signal to one or more shutoff devices associated with the present extinguisher system 10, via another electrical line 34. A circuit board 36 is incorporated with the system 10, with the circuit board 36 preferably including electrical and/or electromechanical means for shutting off electrical power to the circuit associated with the malfunctioning or overheating appliance, and also means for shutting off the water flow through the fitting 12 (and thus from the extinguisher head 24) when some predetermined condition is met.

The circuit board 36 includes a conventional circuit 38 for sending a signal to an electrical shutoff relay 40 via a relay line 42. The relay 40 is connected to the same conventional 115 volt ac circuit 44 as the appliance with which the present system 10 is installed, and also communicates electrically with a ground line 46 for the circuit 44. The relay 40 contacts between the 115 volt side 44 and ground side 46 are normally open, with electrical current passing through the relay 40 to the associated appliance. The appliance power line 48 is shown in FIG. 2. When the relay 40 receives an electrical signal from the relay control 38, the relay contacts close to short out the 115 volt supply line 44 and corresponding ground 46, thus opening any circuit protective device (fuse, circuit breaker, etc.) conventionally installed in each circuit in such an electrical system. This removes any potential electrical ignition source for a fire which may have started, thus insuring that the fire cannot reignite after it has been put out.

Alternatively, it will be seen that the present fire extinguisher system is readily adaptable for use with 220 volt AC electrical systems as well. Many heating appliances which use electricity as their sole power source, utilize 220 volt service. 220 volt service is provided by using both sides of a conventional 115 volt AC system, but rather than grounding one side and using only the 115 volt potential of the single line, both lines are used. As they are 180 degrees out of phase with one another, this results in twice the available voltage, nominally 220 volts (ideally 230 volts in a 115 volt single power line system).

The above described 220 volt system is well known and is used universally in the U.S.A. The present fire extinguishing system is readily adaptable to such 220 volt systems, by connecting the contacts of the relay 40 across the two power wires of the 220 volt system, rather than merely grounding one side, as in a 115 volt system. This alternative is illustrated at the ground or return line 46 of FIG. 2 and unnumbered ground or alternative return line from the GFI of FIG. 3, discussed below. The same effect occurs, i.e., "shorting" the system across the conventional circuit protection device (fuse, circuit breaker, etc.), thereby opening the breaker or blowing the fuse to open the protected circuit. It will also be seen that the present system is readily adaptable to three phase electrical systems, by shorting across any two of the three electrical lines or wires of such a three phase conductor.

Many newer electrical systems may include ground fault interrupters (GFIs) as the circuit protection means. Such devices serve primarily to protect persons from electrical shock, but also shut down the electrical system in the event of an abnormal condition. GFIs operate by detecting the difference in current flow between supply and ground, and opening the circuit when a difference is detected. Thus, the relay 40 could be wired to allow at least some current to flow directly to another ground source than the ground or return line 46 of FIGS. 1 and 2, creating a current flow differential between the two lines 44 and 46 to trip the GFI, generally as shown in FIG. 3 of the drawings.

The present system 10 also preferably includes means for shutting off the water flow as well, after a predetermined condition (time, or temperature drop, etc.) is met. A normally open valve 50 (e.g., centrally pivoted "butterfly" valve, etc.) is installed immediately upstream of the output end 16 of the fitting 12. The valve 50 is held in its normally open position to allow water to flow therepast, by a spring 52 (coil spring, etc.) which engages a pivot shaft 54 upon which the valve 50 pivots. The spring 52 is held in a biased condition, urging the valve 50 closed, by a microswitch finger or catch 56 which engages the edge of a rotary plate 58 beneath the spring 52 and which in turn is secured to the shaft 54. The microswitch catch 56 is selectively retracted or actuated by a conventional timer chip or circuit 60, which includes the conventional electromechanical actuator mechanism for operating the catch 56.

The timer circuit 60 is initiated by input from the water shutoff signal line 34, which in turn is actuated by a water pressure drop or water flow detected by the water flow sensor unit 26. When the timer 60 receives a signal, the timer is started and runs for a predetermined period of time (e.g., twenty or thirty minutes, etc.), whereupon the timer triggers actuation or retraction of the microswitch catch 56. Actuation of the catch 56 permits the spring plate 58 to rotate due to the biasing force of the spring 52, thus causing the pivot shaft 54 to rotate as well. This rotates the butterfly valve 50 to a closed position, shutting off water flow to the extinguisher spray nozzle 24.

The above described automatic water shutoff means can provide considerably reduced repair costs to the homeowner or property owner after the occurrence of a small fire. In many instances, damage due to excessive water results in greater repair costs than those incurred solely as a result of the fire. This is because conventional automatic fire protection and extinguishing systems have no means for shutting off the water supply after the fire has been extinguished. Oftentimes, the water will continue to run for hours, or perhaps a day or more, after the fire has been extinguished, when no one is available to shut off the water supply manually. The above described automatic water shutoff system allows only sufficient water flow to put out the fire, then shuts off the water supply to that particular site in order to reduce water damage to the structure and contents thereof. The timer means may be adjusted as desired, to provide a suitable duration for the water flow.

Figure 4:
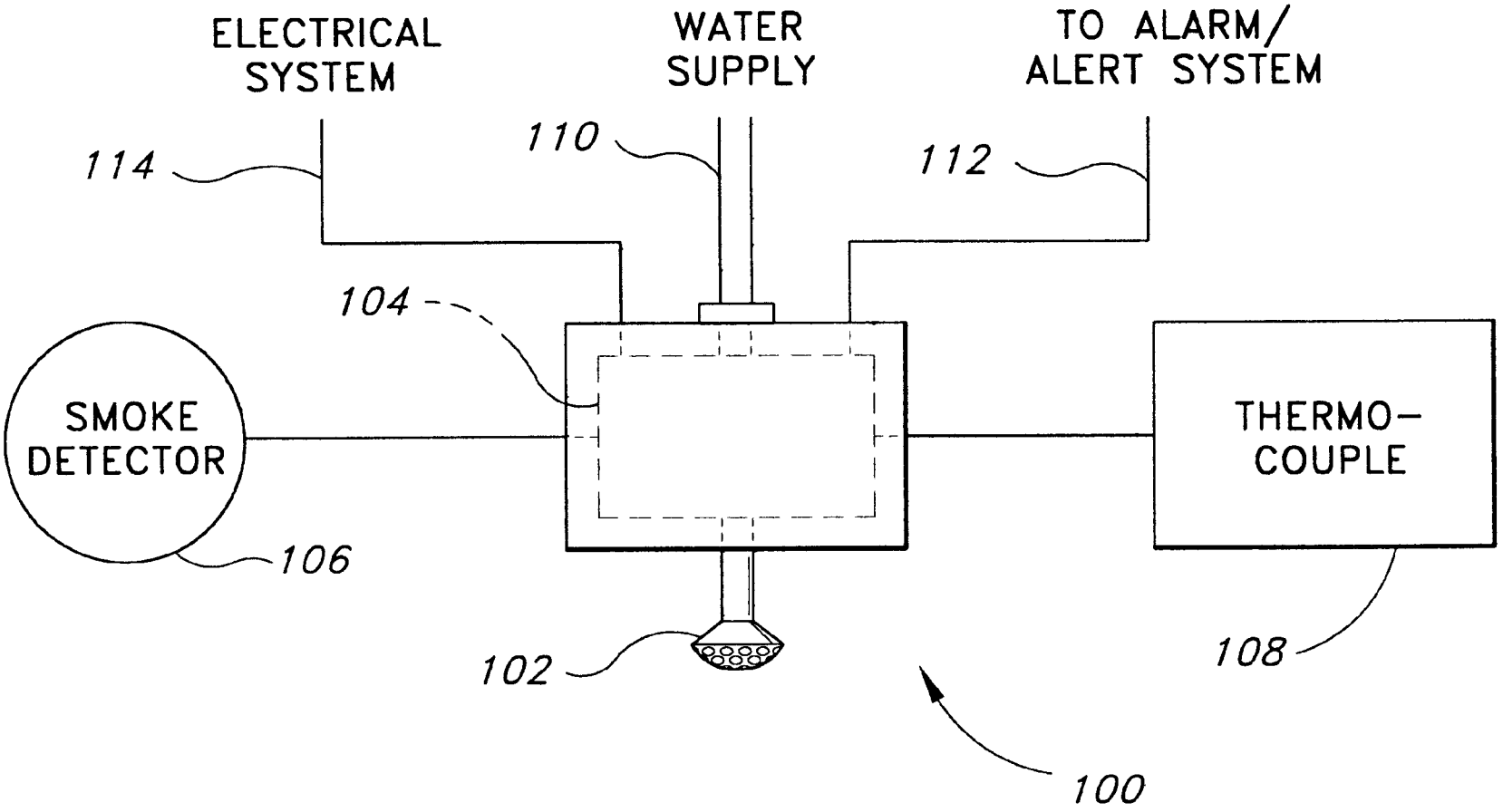
FIG. 4 is a simplified schematic illustration of an alternative embodiment of the present fire extinguishing system, disclosing smoke detector and thermocouple heat sensing means for activation of the present system.

Alternatively, other water control means may be provided as desired. The alternative embodiment 100 of FIG. 4 is equipped with a normally open spray nozzle or head 102, with water control being provided by a conventional electrically actuated, normally closed solenoid valve 104 (shown in broken lines in FIG. 4). The solenoid shutoff valve 104 may be opened by an electrical signal from a conventional smoke detector 106 (considered for the purposes of the present disclosure to be a fire detector as well), and/or a conventional thermocouple or other fire detection means 108 (infrared or optical detection means, etc.).

The water control solenoid valve 104 is normally closed to preclude flow of water therethrough, as noted above. However, when a fire condition (smoke, heat, optically detectible flame, etc.) is detected by one or both of the sensing means 106 and/or 108, an electrical signal(s) is/are sent to the water control valve 104, causing the valve 104 to open. This allows water to flow from the water supply line 110, through the open valve 104, to be sprayed upon the fire from the open spray nozzle 102 to extinguish the fire. The electrical signal(s) provided by the smoke detector 106 and/or thermocouple 108 (or other means) may also send an alarm signal to a local and/or distal alarm via an alarm line 112, using conventional technology generally as described further above for the embodiment 10 of FIGS. 1 and 2. The device 100 may also shut down any associated electrical circuit via an electrical control line 114, generally in the manner described further above for the embodiment 10 of FIGS. 1 and 2.

The embodiment 100 of FIG. 4 has the advantage of having automated fire detection equipment 106 and 108, with the devices 106 and 108 sending a water actuation signal only when a fire is detected. Once the fire condition no longer exists, i.e., no further smoke and/or heat, flame, etc. is detected, the devices 106 and 108 cease to provide electrical output to the water control valve 104, thereby causing the valve 104 to return to its normally closed position, independently of any time duration for any fire which may have triggered actuation of the fire detectors 106 and/or 108.

Returning to FIG. 1 of the drawings, it will be noted that this embodiment 10 has no means for automatically reopening the water control valve 50. In the case of the fire extinguisher system embodiment 10 of FIGS. 1 and 2, the spring 52 continues to hold the butterfly valve 50 in its closed position, regardless of the removal of any electrical signal to the timer and microswitch circuit 60. This is desired, as the conventional fire extinguisher head 24 cannot be reset after it has been opened or activated due to heat from a fire. Thus, it is desired that the water control valve 50 remain closed until the fire extinguisher sprinkler head 24 is replaced with a new, closed unit.

Accordingly, some means must be provided for reopening the control valve 50. this is accomplished by providing a slotted head 62 across the exposed end of the butterfly valve pivot shaft 54. Once the extinguisher head 24 has been replaced, thereby precluding water flow from the outlet end 16 of the fitting 12 under normal conditions, the valve 50 may be reset by inserting a standard screwdriver blade (not shown) into the slot 62 of the water control valve shaft 54 and turning the shaft 54 (and attached valve 50) back to the open position. The mechanism cover 64 may be marked with appropriate "open" and "closed" indicators, respectively 66 and 68, to show the valve position, with the slot 62 of the valve pivot shaft 54 aligning with a respective one of the indicators 66 or 68 to show the valve position. Alternatively, other valve reset means may be provided, e.g., a conventional wing bolt atop the valve pivot shaft 54 with the wings aligned with the valve 50, etc.

The above described fire extinguisher system 10 is quite compact, with most or all of its components fitting within a conventional electrical outlet box 70 or the like. Conventional outlet boxes 70 are formed of metal or plastic, and include a number of prepunched openings or passages 72 therein. These passages 72 are generally incompletely punched, with the installer of the box 70 needing only to "punch out" the appropriate "slugs" remaining in the passages, depending upon the specific number and locations of conduits to be installed therewith. The same basic installation principle applies to the assembly of the present fire extinguishing system invention 10 and/or other embodiments thereof, with two of the passages 72 being opened to provide for the inlet end 14 and outlet 16 end of the fitting 12. The remaining passage 72 shown in broken lines remains closed, as shown in broken lines in FIG. 1, unless it is necessary to open it to provide clearance for the second outlet end 18 of a tee fitting.

The remainder of the componentry of the extinguisher system 10 (or 100) is easily installed within the box 70, with the circuit board 36 fitting closely adjacent the fitting 12 and the distal end 62 of the valve pivot shaft 54 extending through the board 36 and a passage therefor formed through the cover plate 64. While the water flow sensor 26 and electrical circuit shutoff relay 40 are shown disposed to the exterior of the box 70 in FIGS. 1 and 2, it will be seen that they may be installed integrally with the remaining componentry within the box, as shown by the units 10*a,* 10*b,* and 10*c* in the multiple extinguisher assembly shown in FIG. 3.

The present fire extinguisher system 10 is particularly well adapted for installation with (or even within the housing of) a conventional gas or electric clothes dryer C, generally as shown in FIG. 2 of the drawings. It should be noted that the present extinguisher operates equally as effectively with gas heated dryers having a gas supply line G as with electrical appliances, as the gas flow (and other componentry, e.g. drum rotating motor, timer, gas ignition, etc.) are electrically operated. Thus, when the electrical power to the appliance is disconnected by the present fire extinguishing system, as described further above, the gas control solenoid for the gas dryer receives no electrical power and automatically closes, thereby shutting off gas flow to the dryer.

The present system 10, or other embodiment thereof, is also applicable to other appliances as well, as shown in FIG. 3 of the drawings. In FIG. 3, a typical kitchen appliance arrangement is illustrated, comprising a refrigerator R, a dishwasher D, and a stove S. A series of fire extinguisher systems, respectively 10*a,* 10*b,* and 10*c,* are installed adjacent to (or perhaps within the cabinets or housings of) the three appliances R, D, and S. These systems 10*a* through 10*c* differ slightly from the fire extinguisher system 10 of FIGS. 1 and 2, in that all componentry, including the water flow sensor and electrical circuit shutoff solenoid, are contained within the respective boxes 70*a* through 70*c*. This provides for extremely simple connection of the extinguisher systems 10*a* through 10*c,* with it being necessary only to connect water supply lines 74 to the units and plug in or wire the units.

The wiring is a very simple process for the integrated systems 10*a* through 10*c* of FIG. 3, with most electrical connection being accomplished by plugging the system together using conventional electrical plugs and receptacles. By including all electrical componentry within the boxes 70*a* through 70*c,* the power cords 76*a* through 76*c* of the appliances R, D, and S may be plugged into the respective system units 10*a* through 10*c,* with electrical power to the units provided by their respective power cords 78*a* through 78*c*. The only exception is the alarm line 80, which does not use conventional 115 volt ac connectors. Other conventional quick connectors may be provided for the alarm wiring 80, as desired.

It should be noted that FIG. 3 is somewhat simplified, as the electrical power for operation of the fire extinguisher systems 10*a* through 10*c* must be provided by a separate circuit than that providing electrical power for the appliances R, D, and S. This is critical to provide continued electrical power for operation of the systems 10*a* through 10*c,* after they have disconnected the electrical power circuit (s) for the appliances R, D, and S.

The present fire extinguishing system is also operable with gas stoves with minor modification, and may be connected to control gas flow through a gas supply line G2 (shown in broken lines in FIG. 3) for a gas stove or other appliance where gas is supplied continuously thereto. A conventional solenoid actuated gas shutoff valve 82 (shown in broken lines in FIG. 3) may be integrated with the appropriate unit 10*c,* to automatically shut off all gas flow to the gas stove S or other gas appliance.

The system assembly of FIG. 3 also differs from the system 10 of FIGS. 1 and 2, in that the devices 10*a* through 10*c* (and corresponding appliances R, D, and S) are plugged into ground fault interrupters, or GFIs. These devices detect any difference between output and return current flow (amperage), and automatically open the circuit if any difference is detected. Thus, the electrical relays of the respective fire extinguisher systems 10*a* through 10*c* are preferably wired somewhat differently than the relay 40 of FIG. 1, to close a circuit to a secondary ground source, respectively 82*a* through 82*c,* in order to divert at least some current from the GFI. This causes the associated GFI to immediately open its circuit, thereby shutting off all power to the affected appliance.

In summary, the present fire extinguishing system invention provides much needed protection for the homeowner or other party having various major appliances installed within a home or other structure. The present system is particularly well adapted for installation adjacent to or with a conventional gas or electric clothes dryer in the laundry area of a home or other structure, where its effectiveness serves to rapidly quell or extinguish blazes due to lint fires ignited by the heat produced by such dryer appliances. However, the present fire extinguisher system, in any of its embodiments, is also adaptable for use in other areas where major appliances are installed, such as the kitchen, and particularly near the stove, where heat and combustible materials (spilled grease, paper or cloth towels, etc.) are commonly found together.

While the chance of fire from certain kitchen appliances (e.g., a refrigerator R or dishwasher D) may be remote, it is nevertheless true that these appliances are also subject to overheating and malfunction. A dragging, overheated compressor pump motor in a refrigerator, in combination with a collection of dust or other combustible material, can easily lead to a fire beneath or in back of a refrigerator. Such fires behind major appliances are difficult to access. The present invention responds to this potential problem, by providing a fully automated fire extinguishing system which rapidly and effectively extinguishes any fire which may occur due to any appliance with which it is installed. It will also be seen that the present fire extinguishing system may be installed virtually anywhere that there may be some chance of a fire occurring due to electrical malfunction, such as over kitchen counters where smaller appliances (toasters, etc.) are used, or workshop areas with power tools and associated sawdust and other combustible materials, etc. Either rigid, permanently installed metal or plastic pipe or flexible hose may be used, as desired. Accordingly, the present fire extinguisher system in its various embodiments will prove to be a most worthwhile investment for the homeowner or other person wishing to safeguard their property, investments, and personal safety.

It is to be understood that the present invention is not limited to the embodiments described above, but encompasses any and all embodiments within the scope of the following claims.

I claim:

1. A fire extinguishing system for installing with an electrical device receiving electrical power from an electrical circuit having at least one electrical circuit protective device therein, the system comprising:

a pipe fitting having an inflow end and at least one outflow end;

a fire extinguisher sprinkler head installed to said at least one outflow end of said pipe fitting;

a water flow sensor communicating with said inflow end of said pipe fitting, for transmitting an electrical signal when water flows through said pipe fitting;

an electrical circuit shutoff electrically communicating with said water flow sensor, for disconnecting electrical power to the electrical device when water flow occurs through said pipe fitting; and a water shutoff control connected to the pipe fitting, for shutting off water flow from said fire extinguisher sprinkler head when a predetermined condition is met.

2. The fire extinguishing system according to claim 1, wherein:

said electrical circuit shutoff comprises a selectively closable electrical connection across the electrical circuit supplying power to the electrical device, thereby shorting the electrical circuit and opening the electrical circuit protective device associated with the electrical circuit.

3. The fire extinguishing system according to claim 1, wherein:

said electrical circuit shutoff comprises a selectively operable electrical ground from the electrical circuit supplying power to the electrical device, whereby a ground fault interrupter is tripped in order to open the electrical circuit protective device associated with the electrical circuit.

4. The fire extinguishing system according to claim 1, wherein said water shutoff control comprises:

a valve disposed in the pipe fitting; and a timer control connected to the valve for shutting off water flow from said fire extinguisher sprinkler head after a predetermined elapsed period of time has passed.

5. The fire extinguishing system according to claim 1, wherein said water shutoff control comprises:

a valve disposed in the pipe fitting; and at least one fire sensor connected to the valve for shutting off water flow from said fire extinguisher sprinkler head after the fire has been extinguished.

6. The fire extinguishing system according to claim 1, further including a manually operable reset connected to said water shutoff control, for resetting said water shutoff control to an open position after closure thereof.

7. A fire extinguishing system for installing with an electrical device receiving electrical power from an electrical circuit having at least one electrical circuit protective device therein, the system comprising:

a pipe fitting having an inflow end and at least one outflow end;

a fire extinguisher sprinkler head installed to said at least one outflow end of said pipe fitting;

a water flow sensor communicating with said inflow end of said pipe fitting, for transmitting an electrical signal when water flows through said pipe fitting; and an electrical circuit shutoff electrically communicating with said water flow sensor, for disconnecting electrical power to the electrical device when water flow occurs through said pipe fitting.

8. The fire extinguishing system according to claim 7, wherein:

said electrical circuit shutoff comprises a selectively closable electrical connection across the electrical circuit supplying power to the electrical device, thereby shorting the electrical circuit and opening the electrical circuit protective device associated with the electrical circuit.

9. The fire extinguishing system according to claim 7, wherein:

said electrical circuit shutoff comprises a selectively operable electrical ground from the electrical circuit supplying power to the electrical device, whereby a ground fault interrupter is tripped in order to open the electrical circuit protective device associated with the electrical circuit.

10. The fire extinguishing system according to claim 7, further including:

a water shutoff control connected to the pipe fitting, for shutting off water flow from said fire extinguisher sprinkler head when a predetermined condition is met.

11. The fire extinguishing system according to claim 10, wherein the water shutoff control comprises:

a valve disposed in the pipe fitting; and a timer control connected to the valve for shutting off water flow from said fire extinguisher sprinkler head after a predetermined elapsed period of time has passed.

12. The fire extinguishing system according to claim 10, wherein the water shutoff control comprises:

a valve disposed in the pipe fitting; and at least one fire sensor connected to the valve for shutting off water flow from said fire extinguisher sprinkler head after the fire has been extinguished.

13. The fire extinguishing system according to claim 10, further including a manually operable reset connected to said water shutoff control, for resetting said water shutoff control to an open position after closure thereof.

14. A fire extinguishing system for installing with an electrical device receiving electrical power from an electrical circuit having at least one electrical circuit protective device therein, the system comprising:

a pipe fitting having an inflow end and at least one outflow end;

a fire extinguisher sprinkler head installed to said at least one outflow end of said pipe fitting;

a water flow sensor communicating with said inflow end of said pipe fitting, for transmitting an electrical signal when water flows through said pipe fitting; and a water shutoff control, for shutting off water flow from said fire extinguisher sprinkler head and including:

a valve disposed in the pipe fitting; and one of a timer control connected to the valve for shutting off water flow from said fire extinguisher sprinkler head after a predetermined elapsed period of time has passed or at least one fire sensor connected to the valve for shutting off water flow from said fire extinguisher sprinkler head after the fire has been extinguished.

15. A fire extinguishing system for installing with an electrical device receiving electrical power from an electrical circuit having at least one electrical circuit protective device therein, the system comprising:

a pipe fitting having an inflow end and at least one outflow end;

a fire extinguisher sprinkler head installed to said at least one outflow end of said pipe fitting;

a water flow sensor communicating with said inflow end of said pipe fitting, for transmitting an electrical signal when water flows through said pipe fitting;

a water shutoff control, for shutting off water flow from said fire extinguisher sprinkler head when a predetermined condition is met; and a manually operable reset connected to said water shutoff control, for resetting said water shutoff control to an open position after closure thereof.

16. The fire extinguishing system according to claim 14, further including an electrical circuit shutoff electrically communicating with said water flow sensor, for disconnecting electrical power to the electrical device when water flow occurs through said pipe fitting.

17. The fire extinguishing system according to claim 16, wherein:

said electrical circuit shutoff comprises a selectively closable electrical connection across the electrical circuit supplying power to the electrical device, thereby shorting the electrical circuit and opening the electrical circuit protective device associated with the electrical circuit.

18. The fire extinguishing system according to claim 16, wherein:

said electrical circuit shutoff comprises a selectively operable electrical ground from the electrical circuit, whereby a ground fault interrupter is tripped in order to open the electrical circuit protective device associated with the electrical circuit.

* * * * *